United States Patent [19]

Ruff

[11] 4,218,010

[45] Aug. 19, 1980

[54] CONTAINER LID CONVERTIBLE INTO SPOON

[76] Inventor: Stanley L. Ruff, 9 Arbor Dr., New Rochelle, N.Y. 10804

[21] Appl. No.: 47,379

[22] Filed: Jun. 11, 1979

[51] Int. Cl.[2] ..... B65D 3/16; B65D 51/24

[52] U.S. Cl. ..... 229/43; 229/1.5 C; 30/328

[58] Field of Search ..... 229/1.5 C, 43; 30/328

[56] References Cited

U.S. PATENT DOCUMENTS

| | | | |
|---|---|---|---|
| 1,851,942 | 3/1932 | Christie | 30/328 |
| 1,907,737 | 5/1933 | Christie | 30/328 |
| 2,453,393 | 11/1948 | Wilson | 229/1.5 C |
| 3,458,107 | 7/1969 | Lane et al. | 229/1.5 C |
| 3,828,999 | 8/1974 | Humphrey | 229/1.5 C |
| 3,931,925 | 1/1976 | Ruff | 229/43 |
| 4,060,176 | 11/1977 | Tobiasson | 30/328 X |

*Primary Examiner*—Davis T. Moorhead
*Attorney, Agent, or Firm*—Kirschstein, Kirschstein, Ottinger & Cobrin

[57] ABSTRACT

A container lid convertible into a spoon constitutes a one piece water-impermeable sheet of a thermoplastic resin including a flat peripheral ring having a circular outer circumference defining an inner area of three-dimensional configuration including a diametral trough the front end of which flares outwardly and terminates in the plane of the ring. Wings extend laterally outwardly from the side edges of the trough. The front ends of the wings are located at the front end of said side edges. The side edges are weakened whereby as opposite points of the periphery of the lid are squeezed together the rear portions of the wings and of the trough collapse upon one another to form a spoon handle and the front portion of the trough is narrowed and deepened to form a spoon bowl.

9 Claims, 14 Drawing Figures

CONTAINER LID CONVERTIBLE INTO SPOON

BACKGROUND OF THE INVENTION

1. Field of the Invention

Container lid convertible into a spoon

2. Description of the Prior Art

U.S. Pat. No. 3,931,925 discloses a container lid convertible into a spoon. It was designed to replace an inexpensive, flat, thin, wooden spoon that, heretofore, usually individually wrapped in light paper, had been used to scoop out the contents of a container, such as frozen ice cream, soft ice cream, frozen deserts, ices, cottage cheese, etc., and place it in the user's mouth. The containers typically were open-topped and closed by flat paperboard disc lids having tabs to facilitate disengagement with the containers. Inexpensive as the spoons were, they nevertheless represented, en masse, a considerable cost—at the time the application for this patent was filed in 1974, about $2.30 a thousand. Moreover it was the practice to furnish the spoons separately—a nuisance factor—, and it was impossible to match the number of spoons to the number of containers so that it was customary to provide an excess of spoons. The spoons, moreover, were frequently imperfect. They tended to split and break. Also they were rough and, therefore, unpleasant to the tongue and lips of the user.

Although the patented lid/spoon did overcome the problems inherent in flat wooden spoons, it raised fresh problems of its own. The proposed lid, convertible into a spoon, was made of paperboard and included crease/-score lines formed for example by steel rule creasing dies. The purpose of the lines was to facilitate folding of the lid, along the lines, into a configuration that rendered the lid useful as a scoop or spoon. The paperboard of the lid, however, was susceptible to penetrating moisture that might emanate, under certain circumstances, from the product in the container, for example when the container was permitted to stand at a temperature above freezing for a time not long enough to allow its contents to defrost, but long enough to release moisture. The paperboard could be treated to render its undersurface water-impermeable, but if there was a skip in the treatment the spoons made from lids would deform at the skip and cause the product to acquire an unreliable reputation. Moreover the formation of the score/crease lines created transverse tensile stresses in the paperboard at the lines, causing the paper fibers to separate and rendering the lid more vulnerable to penetration by moisture—with consequent softening.

There was a further problem with the patented lid/-spoon, namely that the manipulations to be performed manually upon the lid to transform it into a spoon, although simple, were beyond the innate skills of many small children numbered among the army of consumers of the sweet products packaged in lid-closed containers. A large proportion of the children could not read or comprehend minimal textual or diagramatic instructions if provided on the lids. Hence, the lids, in the absence of the familiar wooden spoons would represent frustrating obstacles whose purchase would be spurned. This single problem was a major drawback to the adoption of the patented lid/spoon.

SUMMARY OF THE INVENTION

1. Purposes of the Invention

It is an object of the invention to provide a novel lid/spoon which avoids the foregoing drawbacks of the patented lid/spoon.

It is another object of the invention to provide a novel lid/spoon which has no inherent susceptibility to penetration by moisture.

It is another object of the invention to provide a novel lid/spoon which is made from water-impermeable sheet material that is capable of being formed to include fold-conditioned zones without lowering the resistance of such zones to moisture penetration.

It is another object of the invention to provide a novel container lid which is preformed to include an embryonic spoon of such configuration that, upon being grasped, it automatically will be so held that the forces applied to the embryonic spoon by a child's fingers will transform the embryonic spoon into a fully fashioned scoop-type spoon.

It is another object of the invention to provide a novel container lid which is so preformed that when grasped it automatically will be so held that it naturally assumes the shape of a spoon.

It is another object of the invention to provide a novel container lid of the character described that, despite its preformed shape which includes that of an embryonic three-dimensional spoon, it nevertheless is capable of being sealingly fitted into the cap seat of a conventional container.

It is another object of the invention to provide a novel lid/spoon of the character described which is easy to use, constitutes but a single part and is convertible rapidly by the least skilled of persons from an aforesaid lid.

It is another object of the invention to provide a novel lid/spoon of the character described which is uniquely individually associated with a single container, so that the spoon is immediately available for use to eat the contents of the container.

It is another object of the invention to provide a novel lid/spoon of the character described which totally eliminates the cost of a separate spoon such as currently is supplied.

It is another object of the invention to provide a novel lid/spoon of the character described which is particularly strong, i.e., capable of ladling out quite hard comestibles, even as hard as frozen ice cream, ices and desserts.

It is another object of the invention to provide a novel lid/spoon of the character described which is readily constructible to be supplied and used in a sanitary condition.

It is another object of the invention to provide a novel lid/spoon of the character described which is extremely inexpensive.

Other objects of the invention in part will be obvious and in part will be pointed out hereinafter.

2. Brief Description of the Invention

The lid/spoon of the present invention is a water-impermeable sheet of a thermoplastic synthetic resin, cut and plastically shaped, e.g. by thermoforming or molding, to a configuration including a flat outer peripheral ring having a circular outer circumference dimensioned to frictionally engage the cap seat of a standard container. The flatness and circularity of the peripheral ring are essential because a cap seat constitutes an internally facing circular groove of which all parts lie in a common plane (horizontal when the bottom of the container rests on a horizontal surface). The flat outer ring preferably is narrow in width inasmuch as its principal function is that of engaging the cap seat and any additional width reduces the effective size of the inner area bounded by said ring and hence of the spoon into which the inner area is to be transformed. A typical width for the ring is from about one-fifth to about one-tenth of the diameter of the lid. The flat outer ring is partially defined by a solid angle that runs along internally facing interiorly concave zones that extend along parts of the inner periphery of the ring. The solid angle extends from the ring downwardly, "downwardly" being defined to mean toward the base of the container in which the lid is seated. The remaining parts of the inner periphery of the ring are not physically demarcated, nor need they be visually demarcated. The remaining parts are smoothly, unbrokenly and continuously extended into the inner area bounded by the ring and may be indistinguishable therefrom. The inner area has a three-dimensional configuration of an embryonic scoop-type spoon. Said area includes a shallow trough the central axis of which is coincident with a diameter of the lid. The trough has a front end that lies in the plane of the ring. From its front end the trough slopes downwardly to its deep rear which is below the plane of the ring. The deep end of the trough is, in plan, adjacent the inner periphery of the ring and is joined thereto by a rear wall of the trough. The side edges of the trough flare laterally outwardly from the rear end of the trough to the front end thereof; said side edges continue, as fold lines, across the width of the ring at the front end of the trough to the outer periphery of the ring. If desired, the trough may be subdivided into a base and side walls by side/base fold lines running the length of the trough approximately parallel to the side edges of the trough. The side/base fold lines continue past the front edge of the trough to terminate at the outer periphery of the ring. Wings extend laterally outwardly from the side edges of the trough to the outer periphery of the ring. Said wings run smoothly and without a break into the ring with which they are flatly coplanar, although, if desired, the wings may slope upwardly at a slight angle, e.g. up to 30°, inwardly from the inner periphery of the ring.

The embryonic spoon is embryonic in the sense that the front end thereof is considerably shallower than the depth of the front end of the ready-to-use spoon. It also is embryonic in the sense that the width (perpendicular to the length of the spoon) is considerably wider than the width of the ready-to-use spoon.

To convert the lid from its embryonic spoon state, the lid after removal from the container is squeezed laterally. More particularly, the opposite wings of the embryonic spoon, which extend to the outer periphery of the lid, are squeezed toward each other. It is unnecessary with the described configuration of the lid/spoon, as in the case of the patented lid/spoon, to press downwardly with one finger at the center of the handle and to press inwardly with two of the fingers at opposite sides of the lid; rather with the present lid/spoon all the user has to do is to squeeze the wings toward one another; downward pressure on the center of the spoon no longer has to be applied due to the preexisting shape of the embryonic spoon which encourages the bowl to move downwardly when the wings are squeezed toward each other.

BRIEF DESCRIPTION OF THE DRAWINGS

In the accompanying drawings in which is shown one of the various possible embodiments of the invention.

PREFERRED EMBODIMENT OF THE INVENTION

Figure 2:
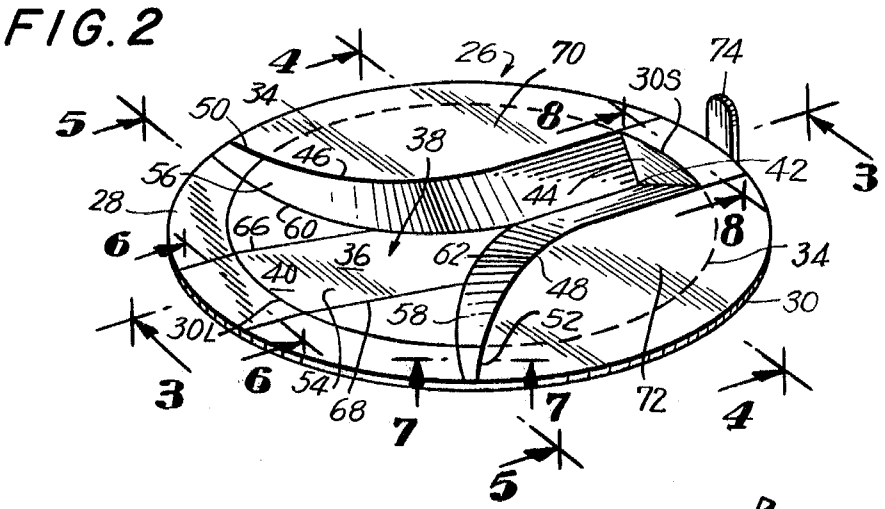
FIG. 2 is a perspective view of the lid/spoon as the original is made and used to close the container.

Referring now in detail to the drawings, the reference numeral 20 denotes a conventional container such as is used in huge quantities to package sundry foodstuffs such as, by way of example, frozen ice cream, soft ice cream, custards, frozen desserts, ices, sherberts, salads, spoonable cheese like cottage cheese, yogurt and sour cream. Typically, such containers are made from paperboard or plastic that have a form-reinforced rim 22 below which is indented an internally facing circular groove 24 known as a "cap seat". In a conventional container a flat paperboard lid is snapped into the cap seat. The lid includes a lifting tab to assist in its removal. Heretofore, such containers were opened at the time of sale to the purchaser and were supplied with a wrapped wooden spoon, a separate one for each container. The lids were thrown away after the container was opened. In U.S. Pat. No. 3,931,925 the lid was pre-scored to enable it to be transformed into a spoon. The disadvantages of such lid/spoons made of paperboard and furnished originally in the flat have been discussed above.

Pursuant to the present invention, the container 20 is provided with a lid 26 of a unique novel three-dimensional configuration such that it can be transformed into a useful scoop-type spoon by manual manipulation without the necessity of previously instructing a user as to the steps to be practiced to achieve such transformation. More particularly, the lid 26 is made of a water-impermeable sheet of thermoplastic synthetic resin. A typical satisfactory material is high impact polystyrene. Another typical satisfactory material is high density polyethylene. The material should be thick enough so that it is self-form-maintaining, that is to say, it should not be limp. Moreover the material should be thick enough so that when the lid is in its ready-to-use configuration the lid is sufficiently rigid to be used as a scoop for frozen materials such as ices or ice cream. For this purpose the lid preferably has a thickness in the order of ten to fifteen mils. The material such as just described in the thickness range just mentioned is strong and relatively inexpensive. It is sufficiently flexible for the manipulation described below.

The lid 26 is of one piece, however, it constitutes several parts which are mutually unitary. More particularly the lid includes a flat outer peripheral ring 28 having a circular outer periphery 30. The diameter of the outer periphery is such that the ring is dimensioned to frictionally engage the cap seat 24 of a standard container 20.

It is essential to the proper functioning of the present invention that the ring 28 be flat and circular because the cap seat 24 is a groove all the parts of which lie in a common plane that is horizontal when the bottom of the container rests on a horizontal surface. If the ring were not flat or not circular the ring could not form a proper sealing fit for closure of the container.

The width of the ring, that is to say the lateral thickness of the ring, is narrow. This is desired since the primary function of the ring is to engage the cap seat, and any extra width reduces the effective size of the portion of the lid bounded by the ring and hence reduces the size of the spoon into which this inner portion is to be transformed. A typical width of ring is from about one-fifth to about one-tenth the diameter of the lid. The inner periphery of the ring is partially defined by a solid angle the apex 32 of which extends along internally facing interiorly concave zones. There are two such zones, one constituting a long arc 30L and the other a diametrically opposed short arc 30S. The equiangular portions of the inner periphery between the zones 30L and 30S are indistinguishable from the inner area of the lid circumscribed by said zone; however for the purpose of description, these portions have been illustrated in FIG. 2 by dotted arcs 34. In practice said portions of the inner periphery denoted by these dotted lines are not physically demarcated. It will be seen, as the description proceeds, that no physical demarcation is necessary. Nor indeed is there any necessity for a visual demarcation of these parts. As has been pointed out above, the thrust of the present invention is the elimination of the necessity for any type of instructions, either textual or diagramatic, to teach a user how to transform the lid 20 into a ready-to-use spoon, it being the purpose of the present invention to so structure the lid that such conversion essentially is automatic. Thus the portions 34 of the ring 28 extend unbrokenly and continuously, and in a common horizontal plane, into an inner area 36 bounded by the inner periphery of the ring. The junctions between the ring and said inner area are mutually indistinguishable at these portions.

The inner area 36, as will be seen from inspection of FIG. 2 in which this inner area is shown in its as-fabricated condition, it having as yet not been stressed to change its configuration into a ready-to-use spoon, has a three-dimensional configuration which is that of an embryonic scoop-type spoon. Speaking in general terms, the inner area bears a likeness to a scoop-type spoon but it is not useful as one nor does it precisely resemble one. It differs from a ready-to-use scoop-type spoon in that the bowl is much too flat and much too broad at its front end and the embryo spoon has no clearly defined easily manipulatable handle. These differences must be eliminated before the inner area can be used properly for a scoop-type spoon.

Figure 3:
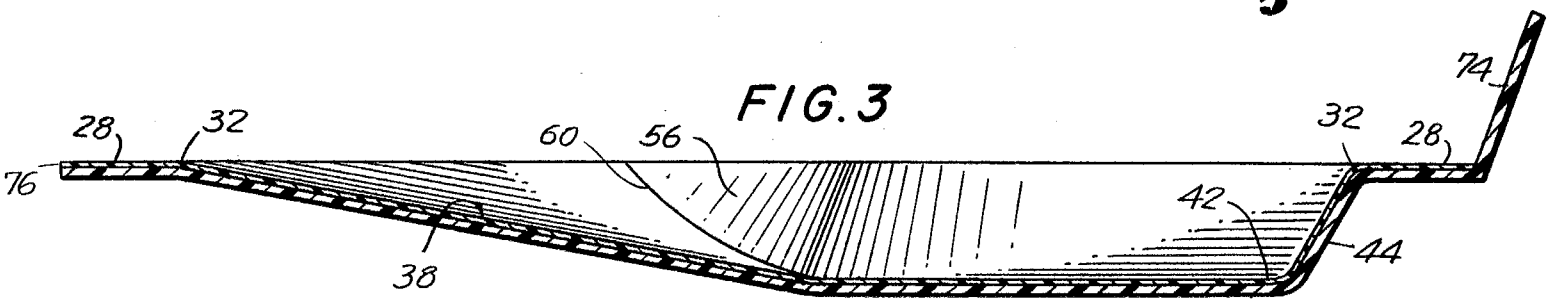
FIGS. 3, 4, 5, 6, 7 and 8 are sectional views taken substantially along the lines 3—3, 4—4, 5—5, 6—6, 7—7 and 8—8, respectively, of FIG. 2.
Figure 4:
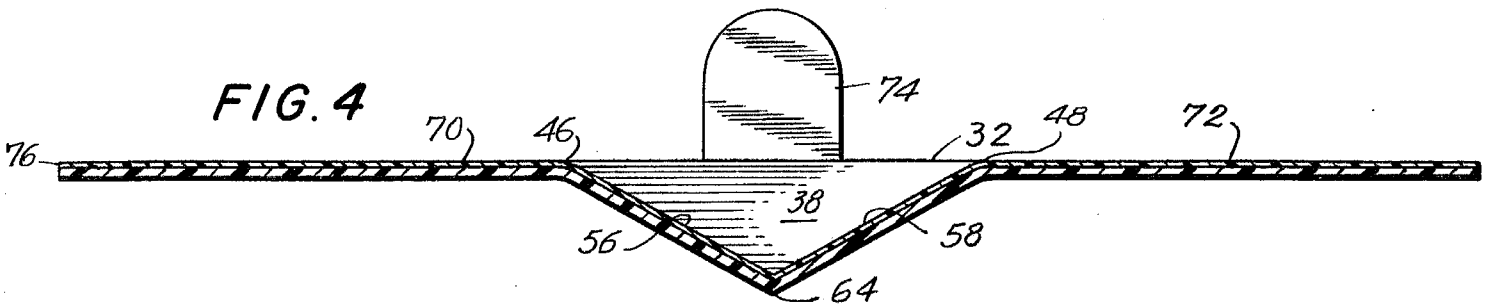
Figure 1:
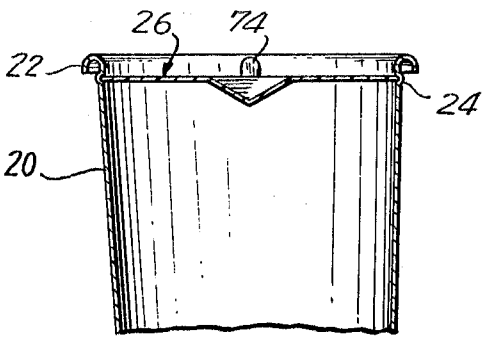
FIG. 1 is an axial fragmentary sectional view of an opened-mouthed container which is closed by a lid/spoon embodying the present invention.

More particularly, the inner area includes a shallow trough 38 the central axis of which is coincident with a diameter of the lid. The trough has a front end 40 that lies in the plane of the ring 28. From its front end the trough slopes downwardly (see FIG. 3) to a deep rear end 42 (see FIG. 3) which is below the plane of the ring 28. The deep end of the trough is displaced only slightly inwardly, as viewed in plan, from the adjacent short arc 30S of the ring. This slight displacement readily can be appreciated from inspection of FIG. 3. The rear end 42 of the trough is joined to the ring by a rear wall 44.

The trough has side edges 46, 48. At the rear end of the trough the side edges extend forwardly from the inner periphery of the ring at the ends of the short arc 30S. The side edges flare out as they approach the diametrically opposite side of the lid and are quite widely spaced apart where they join the opposite ends of the long arcuate segment 30L that is opposed to the short arcuate segment 30S. The side edges 46, 48 are in the configuration of solid angles the tops of which are in the plane of the ring and the sides of which slope downwardly and inwardly. The said side edges of the trough continue forwardly, although not as solid angles, beyond the inner periphery of the ring at the arc 30L to the outer periphery of the ring as fold lines 50, 52. The fold lines 50, 52 constitute weakened zones of reduced thickness created by grooves 53 in the undersurface of the lid so that the fold lines are fold-conditioned to urge the bottom of the trough downwardly when inward lateral pressure is applied to the periphery of the lid. Such grooves are desirable but not essential.

If desired, the front half of the trough, instead of presenting an upwardly concave arcuate configuration, may be subdivided into a base 54 (see FIG. 5) and side walls 56, 58. The base of said front half is substantially flat, sloping upwardly gradually to the plane of the rim 28 at the front of the trough. The side walls 56, 58 slope upwardly and outwardly at a steeper angle than the base from the side edges of the base to the fold lines 50, 52. The lower edges of the side walls 56, 58 are defined by fold lines 60, 62 constituting weakened zones created by grooves 63 in the undersurface of the lid for fold-conditioning of the side walls away from the plane of the rim when lateral inward pressure is applied to the periphery of the lid. These lines merge into a common fold line 64 at approximately the mid point of the length of the trough. The sides of the base 54 are defined by fold lines 66, 68 that extend forwardly toward the front of the trough from somewhat forward of the point where the fold lines 60, 62 merge with each other. The fold lines 66, 68 are approximately parallel to each other and are formed by weakened zones created by grooves 69 in the upper surface of the lid so that these lines are fold-conditioned to depress the base of the trough upon application of inward lateral pressure applied to the periphery of the lid. The fold lines 66, 68 run from their points of junction with the fold lines 60, 62 to the inner periphery of the rim 28 and continue forwardly to the outer periphery of the rim as can be seen in FIG. 2.

The depth of the trough at its rear end is defined by the rear wall 44 and is approximately equal to (actually slightly less than) the depth of a ready-to-use spoon; however, the depth of the trough at its front end is insufficient for use in a ready-to-use spoon and, indeed, the front end depth of the trough is essentially nonexistent. It is in this respect, as well as the general flatness of the front end of the spoon and excessive width, that the spoon still is in embryonic form and must be modified to transform it into a ready-to-use spoon.

The fold lines 50, 52 cross the rear of the rim in an outward direction from the ends of the arc 30S.

The lid further includes wings 70, 72 a different one at each differently side edge of the trough. The wings run smoothly and without a break into the ring with which they are flatly coplanar. Optimally, the wings may slope upwardly at a small angle, e.g. up to 30°, inwardly from the inner periphery of the ring to the side edges 48, 50 of the trough. The front ends of the wings are located at the front ends of the side edges 48, 50.

Finally, the lid includes a tab 74 which is conventional and which conveniently is positioned to avoid interference with the use of the lid when employed as a spoon. For this purpose the tab, which is in one piece with the lid, extends radially outwardly away from the outer periphery of the ring at a point which angularly corresponds to the mid point of the short arc 30S.

It will be appreciated that when the filled and closed container is shipped in commerce, transferred to a display location, and handled by purchasers and at the check-out counter, the exterior surface of the lid will be contaminated and this might be considered unsanitary by health authorities if the lid is to be used as a spoon. Pursuant to the present invention, this is avoided by covering the upper surface of the lid with a strippable layer 76 (not shown in FIGS. 9 and 10 but illustrated in the sectional views constituting FIGS. 3 through 8). This layer can be of any thin, flexible material such, for instance, as paper, glassine or a plastic film. A plastic film is preferred. Where the lid is composed of a high impact polystyrene a suitable material for the strippable layer is a high density polyethylene film. Where the lid is composed of high density polyethylene sheet material a suitable strippable film is extensible Kraft paper. The strippable film is adhered to the upper surface of the lid in a manner well known to the art, for example with the aid of a wax adhesive.

The lid is formed in a sheet of a suitable plastic such as mentioned above, the formation preferably being for the use of dies, e.g. a male and female die, or a female die solely that functions as a vacuum forming die. The die imparts the three-dimensional configuration described in detail above. After the configuration is imparted the sheet is trimmed around the formed area to provide the circular outline that is necessary. If desired the lid can be formed by injection moldings or any other suitable process of thermoplastic molding.

Figures 5, 6, 7, 8, 9, 10, 11:
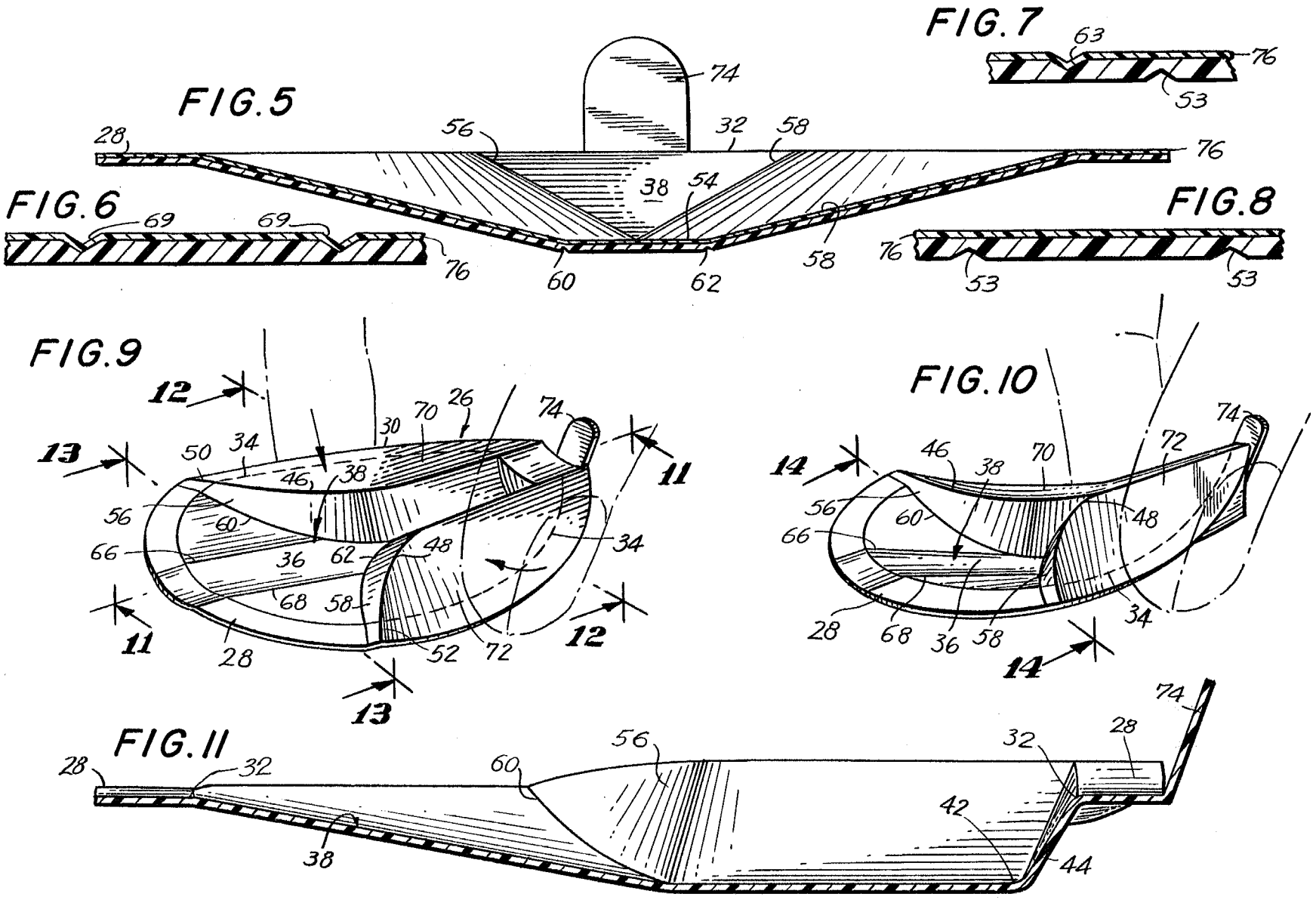
FIG. 9 is a view similar to FIG. 2 but showing the lid/spoon as it appears when partially laterally squeezed.
FIG. 10 is a view similar to FIG. 9 but showing the lid/spoon as it appears when squeezed sufficiently to function as a ready-to-use spoon.
FIGS. 11, 12 and 13 are sectional views taken substantially along the lines 11—11, 12—12 and 13—13, respectively, of FIG. 9.
Figure 12:
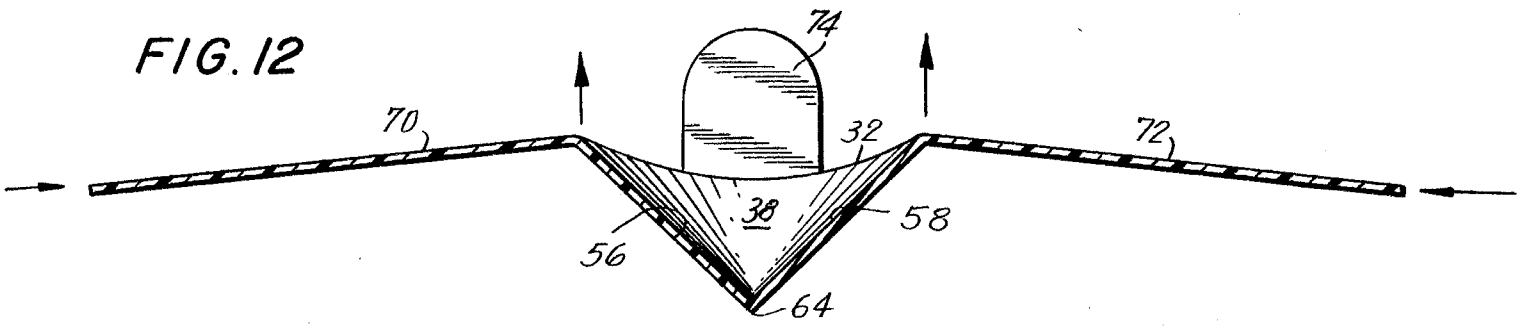
Figure 13:
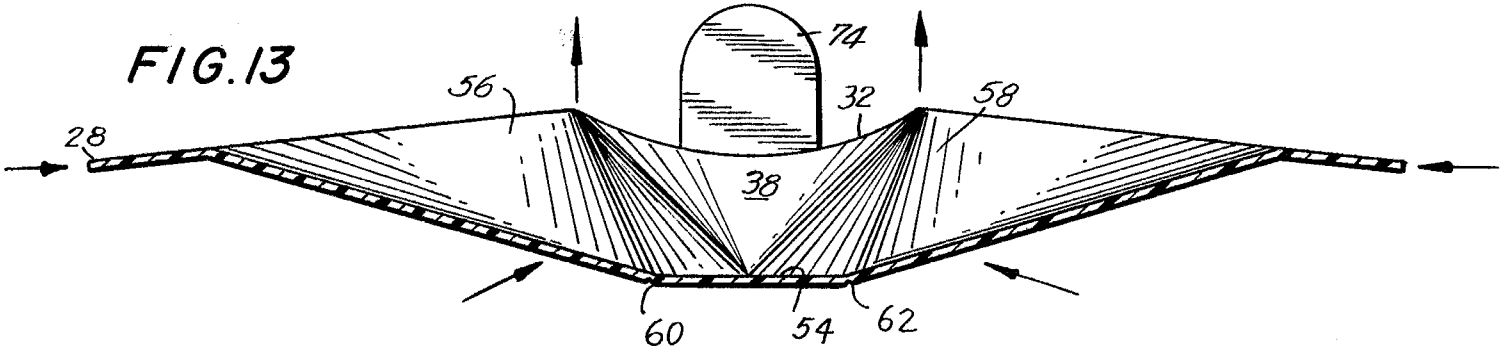
Figure 14:
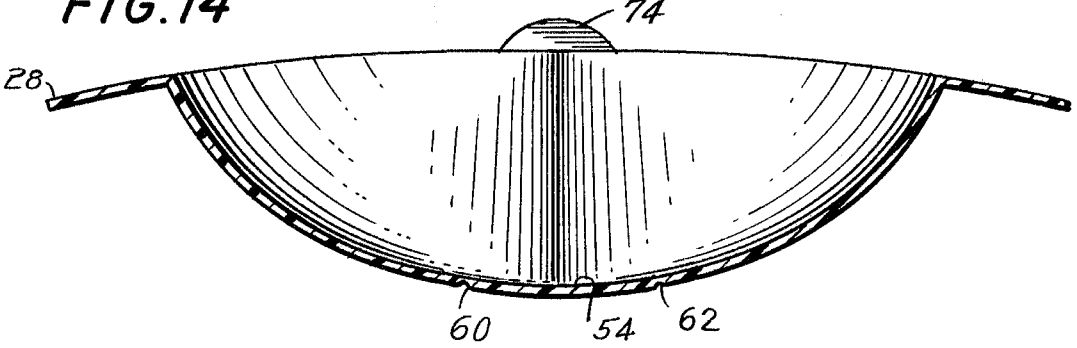
FIG. 14 is a sectional view taken substantially along the line 14—14 of FIG. 10.

To convert the lid from its configuration as it is formed to close the container, to the configuration it is to assume when ready for use, first the lid is removed from a full container from which a user desire to scoop its contents and insert the same spoonful by spoonful into his mouth and then he strips the sanitation-maintaining layer 76 to leave the germ-free upper surface of the lid exposed. Next the user places a thumb and index finger (any other finger opposed to the thumb could be used) on diametrically opposite sides of the lid midway between the arcs 30L and 30S and squeezes the lid between the fingers. Preferably, although not necessarily, the lid is grasped between the two finger tips with a portion of the balls of each of the tips overlying and contacting the upper surface of the wings; thereby as the lid collapses transversly the finger pads push the wings down with respect to the side edges 46, 48. The three-dimensional configuration of the lid after the lid has been partially transversly squeezed is illustrated in FIG. 9. Attention is called to the fact that the wings and adjacent portions of the rim have started to angle downwardly and the front of the trough has moved downwardly with respect to the side edges 46, 48 but has not yet reached its final to-be-used position. The configuration and relative positions of the various components of the lid also can be seen by inspection of FIGS. 11, 12 and 13. Attention is called to the fact that the flaring front ends of the fold lines 60, 62 now turn upwardly to a greater extent than in the as-formed lid. It also is noted that the segment of the rim coincident with the arc 30S has deviated from its flat position and assumed an upwardly concave configuration. This somewhat depresses the rear end of the trough; furthermore the rear ends of the side edges 46, 48 have started to approach one another.

Eventually, the lateral squeezing of the lid will cause the lid to assume the configuration shown in FIG. 9. At this time the rear portions of the side edges 46, 48 touch along their lengths and the rear halves of the side walls 56, 58 abut each other. These portions of the side walls together with the rear portions of the wings at this time are vertical and the latter are in contact with the outer surface of the rear halves of the side walls to form a handle which is grasped by the same two finger tips that were employed to squeeze the back part of the lid together. Also at this time the bowl of the spoon is fully formed into a scoop-like configuration with the base 54 substantially coplanar with the fold lines 64 and with the front end of the trough removed.

The various movements above described of the sundry parts of the lid as the lid is transformed into a ready-to-use spoon is facilitated not only by the three-dimensional configuration of the lid with its embryonic spoon but also by the various weakened zones and is further assisted by the fold-conditioned lines which precondition the lines for folding in the desired directions.

It will thus be seen that there is provided an article which achieves the several objects of the invention and which is adapted to meet the conditions of practical use.

As various possible embodiments might be made of the above invention, and as various changes might be made in the embodiment set forth, it is to be understood that all matter herein described or shown in the accompanying drawings is to be interpreted as illustrative and not in a limiting sense.

Having thus described the invention, there is claimed as new and desired to be secured by Letters Patent:

1. A container lid adapted to be converted into a scooptype spoon, said lid being formed of a single piece of waterimpermable thermoplastic material and having a flat peripheral ring with a circular outer circumference defining an inner area of three-dimensional configuration in the shape of an embryonic scooptype spoon which includes a shallow trough extending diametrically between opposed zones of the inner circumference of the ring, said trough having a wide front end and a narrow rear end, the front end flaring outwardly and terminating in the plane of the ring, said inner area further including wings that extend outwardly to the inner circumference of the rim from the side edges of the trough and terminate at their front ends at the terminations of the front ends of the side edges of the trough at the inner circumference of this rim whereby when the periphery of the run is squeezed by finger pressure at the wings the rear ends of the trough and the wings collapse upon one another to form a spoon handle and the front portion of the trough is narrowed and deepened to form a spoon bowl.

2. A lid as set forth in claim 1 wherein the side edges of the trough constitute weakened zones to expedite folding of the lid at said edges upon the application of finger pressure to the periphery of the lid.

3. A lid as set forth in claim 2 wherein the weakened zones are fold-conditioned to ensure proper folding such that the sides of the trough become steeper upon the application of finger pressure as aforesaid.

4. A lid as set forth in claim 3 wherein the weakened fold-conditioned zones constitute grooves of the undersurface of the lid.

5. A lid as set forth in claim 1 wherein the front portion of the trough is subdivided by fold lines into a base and side walls.

6. A lid as set forth in claim 1 in which the wings are coplanar and unbrokenly continuous with the inner circumference of the rim.

7. A lid as set forth in claim 1 wherein the ring is narrow.

8. A lid as set forth in claim 7 wherein the width of the ring is between about one-fifth and one-tenth of the diameter of the lid.

9. In combination with a lid as set forth in claim 1 a sanitizing film overlying the entire upper surface of the lid and strippably adhered thereto.

* * * * *